United States Patent [19]

Courson

[11] 4,050,633

[45] Sept. 27, 1977

[54] SPRAY BARS FOR METAL ROLLING

[75] Inventor: Richard B. Courson, Grosse Pointe Park, Mich.

[73] Assignee: Almo Manifold & Tool Company, Center Line, Mich.

[21] Appl. No.: 726,985

[22] Filed: Sept. 27, 1976

[51] Int. Cl.[2] ..... B05B 1/14

[52] U.S. Cl. ..... 239/550; 239/600

[58] Field of Search ..... 239/550, 600, 266

[56] References Cited

U.S. PATENT DOCUMENTS

| | | | |
|---|---|---|---|
| 2,605,140 | 7/1952 | Bartling | 239/550 |
| 3,407,023 | 10/1968 | Hirschberg et al. | 239/600 |
| 3,771,730 | 11/1973 | Nicoloff et al. | 239/550 |

*Primary Examiner*—Robert W. Saifer

*Attorney, Agent, or Firm*—William L. Fisher

[57] ABSTRACT

Improvement in a spray bar for metal roller having a layered body and a plurality of spray nozzles carried thereon, the improvement comprising apparatus providing access from the rear of the spray bar to the nozzles for servicing thereof, the apparatus including for each nozzle an elongated housing fastened on the spray bar so that the former projects outwardly from the front face of the latter, an elongated member joined to the nozzle to form a cartridge nozzle which fits in the housing, and an access opening in the rear of the spray bar for inserting the cartridge nozzle into the housing or removing the same therefrom.

10 Claims, 2 Drawing Figures

SPRAY BARS FOR METAL ROLLING

My invention relates to liquid spray systems for metal rolling.

The principal object of my invention is the provision of improvements in spray bars for metal rolling by which the spray nozzles carried thereon are more accessible than heretofore.

Figure 1:
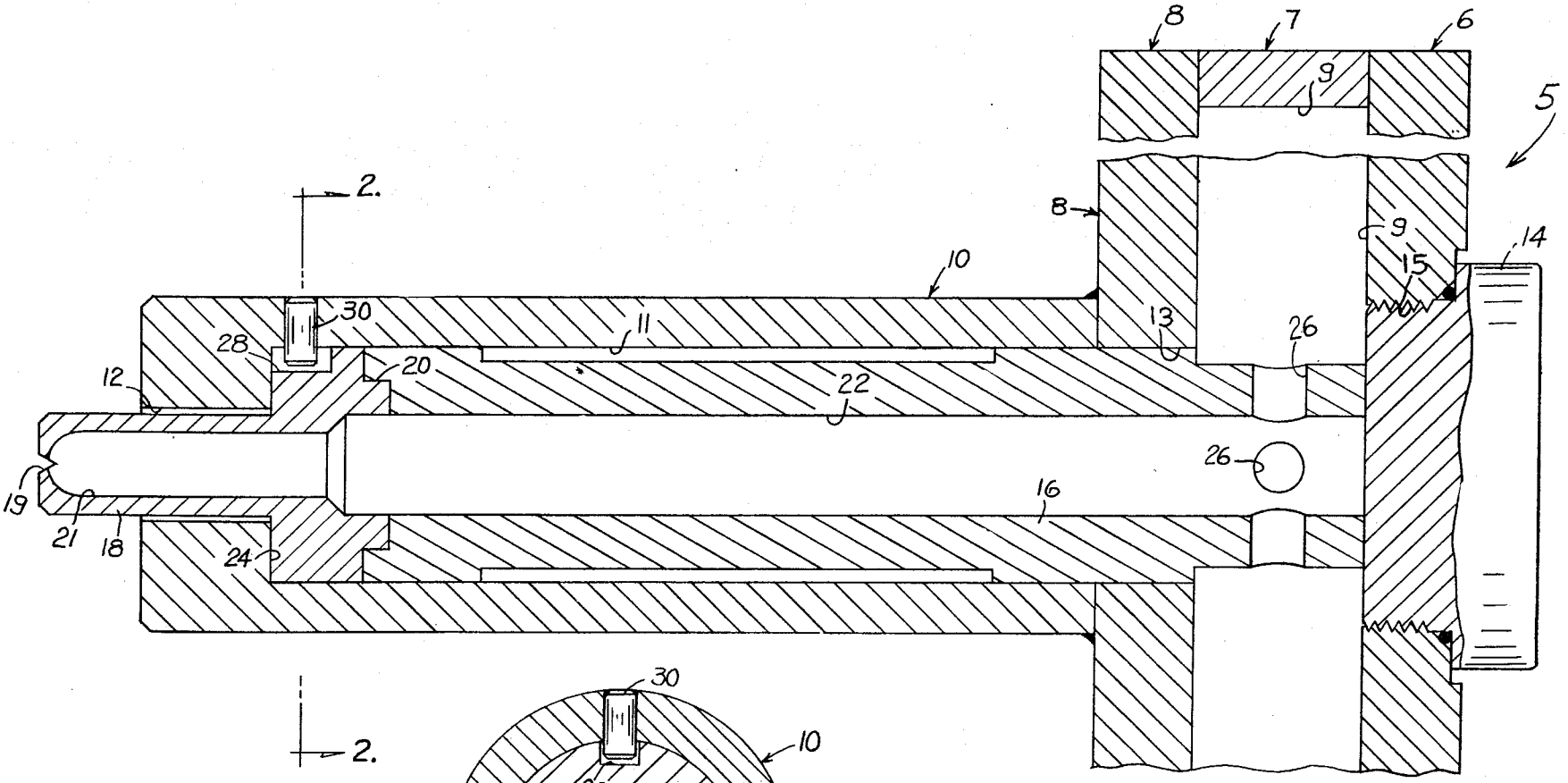
Figure 2:
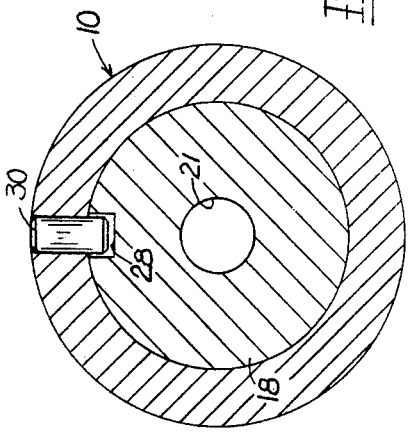

The foregoing object of my invention and the advantages thereof will become apparent during the course of the following description, taken in conjunction with the accompanying drawings, in which:

FIG. 1 is a transverse sectional view of a spray bar embodying my invention; and FIG. 2 is a longitudinal sectional view of the structure of FIG. 1 taken on the line 2-2 thereof.

Referring to the drawings in greater detail, 5 generally designates said spray bar which consists of an elongated body formed of metal layers 6, 7 and 8 bonded together as described in my prior U.S. Pat. No. 3,771,730. A liquid passage 9 is formed in the layer 7. Cooling liquid enters the passage 9 through any suitable liquid inlet for said spray bar 5. On the front layer 8 is welded a hollow housing 10 having cavities 11 and 12 formed therein. Said cavities 11 and 12 form a shoulder 24 therebetween.

Carried in said housing 10 is a hollow cartridge nozzle consisting of an elongated body 16 and a shouldered spray nozzle 18 which are press fitted together along a joining line 20. Said cartridge nozzle has liquid passages 21 and 22 formed therein, inlet apertures 26 formed in rear end thereof and an outlet aperture in the front end thereof in the form of a slit 19 fabricated in the nozzle 18. Said nozzle 18 has an open ended slot 28 formed in a radially enlarged portion thereof which slot 28 receives and accommodates a locating pin 30 press fitted in a wall of said housing 10. By means of said slot 21 and pin 30 all of the cartridge nozzles can be orientated on the spray bar 5 as desired. Said cartridge nozzle extends rearwardly through an aperture 13 formed in the front layer 8 to reach the rear layer 6 where its rear end abuts the front end of an access plug 14 threadably engaged in a threaded aperture 15 formed in said rear layer 6. The plug 14 carries an O-ring to form a liquid-tight seal with the rear layer 6 and in turn forces the shoulder of said cartridge nozzle against the shoulder 24 to form a liquid-tight seal therebetween. This seal formed by the bottoming of these two shoulders is aided by the seal formed between the cylindrical surface of said cartridge nozzle and that of said housing 10 and aperture 13. The cylindrical surface of the body 16 is undercut as shown to facilitate forming this latter seal. Said opening 15 provides access from the rear face of the spray bar 5 to the cartridge nozzle for servicing thereof, i.e. cleaning, repair or replacement.

In assembly and operation of said spray bar 5 each cartridge nozzle is inserted into the spray bar 5 from the rear thereof through its respective access opening 15 and orientated on said spray bar 5 by rotating the same until its slot 28 is aligned with its respective locating pin 30. The respective access plug 15 is then replaced and tightened until the shoulder of the cartridge nozzle bottoms on the shoulder 24 to form a liquid-tight seal therebetween. When all of the cartridge nozzles have been thus assembled on the spray bar 5 the latter is installed on suitable metal rolling machinery along with many other like spray bars. All such spray bars are installed so that their longitudinal axes are generally transverse to the direction of metal rolling as is well known. In the case of each spray bar 5 cooling liquid enters the liquid passage 9 from a liquid inlet which is preferably offset from the cartridge nozzle and access opening 15 such as shown in my prior U.S. Pat. No. 3,771,730 for the liquid inlet 18 which is shown offset in relation to the liquid passages 19 and 21. The cooling liquid which enters the passage 9 enters the cartridge nozzle via the inlets 26 and travels along the passages 21 and 22 and leaves the spray bar 5 through the slit 19 in the nozzle 18. Said cartridge nozzle can be used singly as shown herein or in conjunction with other like cartridge nozzles fed from a flow control zone to achieve cubic equality of liquid flow as shown in my prior U.S. Pat. No. 3,771,730. All such cartridge nozzles are readily serviced from the rear of each spray bar 5 which is a considerable convenience considering the nature of metal rolling machinery.

It will thus be seen that there has been provided by my invention improvements in spray bars for metal rolling in which the object hereinabove set forth, together with many thoroughly practical advantages, has been successfully achieved. While a preferred embodiment of my invention has been shown and described it is to be understood that variations and changes may be resorted to without departing from the spirit of my invention as defined by the appended claims.

What I claim is:

1. Improvement in a spray bar for metal rolling having a layered body and a plurality of spray nozzles carried thereon, said improvement comprising means providing access from the rear of said spray bar to said nozzles for servicing thereof, said means including for each nozzle an elongated housing fastened on said spray bar so that the former projects outwardly from the front face of the latter, an elongated member joined to said nozzle to form a cartridge nozzle which fits in said housing, and an access opening in the rear of said spray bar for inserting said cartridge nozzle into said housing or removing the same therefrom.

2. Improvement as claimed in claim 1, means including mating radial shoulders on the inside surface of said housing and the outside surface of said cartridge nozzle forming a liquid-tight seal therebetween.

3. Improvement as claimed iin claim 2, an access plug for said access opening, the tightening of said plug in said opening pushing upon said cartridge nozzle to bottom said shoulder thereon against the shoulder in said housing.

4. Improvement as claimed in claim 1, pin and slot means between said housing and cartridge nozzle so that proper fitting of the latter in the former orientates said cartridge nozzle on said spray bar.

5. Improvement as claimed in claim 4, said pin and slot means at the front end of said housing and cartridge nozzle so that the latter is rotatable from the rear of said spray bar for fitting it in said housing.

6. Improvement in a spray bar for metal rolling having a layered body and a plurality of spray nozzles carried thereon, said improvement comprising the method of providing access from the rear of said spray bar to said nozzle for servicing thereof, said method including fastening on said spray bar for each nozzle an elongated housing so that the latter projects outwardly from the front face of said spray bar, said method including joining an elongated member to each nozzle to form an elongated cartridge nozzle which fits in said housing, and providing an access opening in the rear of said spray bar for inserting said cartridge nozzle into said housing or removing the same therefrom.

7. Improvement as claimed in claim 6, said method further comprising utilizing the inside surface of said housing and the outside surface of said cartridge nozzle including mating radial shoulders thereon to form a liquid-tight seal therebetween.

8. Improvement as claimed in claim 7, said method further comprising utilizing an access plug for said access opening and tightening said plug in said opening so as to push upon said cartridge nozzle to bottom said shoulder thereon against the shoulder in said housing.

9. Improvement as claimed in claim 6, said method further comprising providing pin and slot means between said housing and said cartridge nozzle so that proper fitting of the latter in the former orientates the latter on said spray bar.

10. Improvement as claimed in claim 9, providing said pin and slot means at the front end of said housing and cartridge nozzle so that the latter is rotatable from the rear of said spray bar for fitting it in said housing.

* * * * *